US008894432B1

(12) United States Patent
Ward et al.

(10) Patent No.: US 8,894,432 B1
(45) Date of Patent: Nov. 25, 2014

(54) CONNECTOR ASSEMBLY

(71) Applicant: Cobham Defence Communications Limited, Dorset (GB)

(72) Inventors: Neil Ward, Rishton Nr Blackburn (GB); Michael Briggs, Blackburn (GB); Colin Jones, Appelton Thorn (GB); Stephen Smith, Darwen (GB)

(73) Assignee: Cobham Defence Communications Limited, Dorset (GB)

( * ) Notice: Subject to any disclaimer, the term of this patent is extended or adjusted under 35 U.S.C. 154(b) by 0 days.

(21) Appl. No.: 14/267,244

(22) Filed: May 1, 2014

(51) Int. Cl.
*H01R 4/50* (2006.01)
*H01R 13/627* (2006.01)

(52) U.S. Cl.
CPC ..... *H01R 13/627* (2013.01)
USPC ..... 439/345

(58) Field of Classification Search
CPC ... H01R 13/627; H01R 13/62; H01R 13/6278
USPC ..... 439/345, 341, 333, 337
See application file for complete search history.

(56) References Cited

U.S. PATENT DOCUMENTS 7,104,828 B1 * 9/2006 Lin ..... 439/337
7,125,159 B2 * 10/2006 Hirsch et al. ..... 362/651
7,448,911 B2 * 11/2008 Yang ..... 439/619
8,562,368 B2 * 10/2013 Boyer ..... 439/345
2011/0177708 A1 7/2011 Smith

FOREIGN PATENT DOCUMENTS

| | | | |
|---|---|---|---|
| CN | 2919591 | Y | 7/2007 |
| CN | 201975572 | U | 9/2011 |
| DE | 25 26 762 | | 12/1976 |
| GB | 1 234 759 | A | 6/1971 |

OTHER PUBLICATIONS

Search Report for GB 1308252.4; dated Oct. 31, 2013; 4 pages.

* cited by examiner

*Primary Examiner* — Xuong Chung Trans
(74) *Attorney, Agent, or Firm* — Foley & Lardner LLP

(57) ABSTRACT

A connector assembly for fitment to a vehicle. The connector assembly includes a base unit for mounting to a vehicle and an expander unit. The expander unit is configured to attach to and detach from the base unit. The base unit includes a base connector face having at least two opposite edges and having therein a base connector and the expander unit includes an expander connector face having an expander connector. The expander connector is configured to connect with the base connector for communicating a signal therebetween when the expander unit is attached to the base unit. Two pins protrude from the base connector face. Two latch plates are mounted to the expander connector face. The pins and connector have relative positions matching the relative positions of the latch plates and connector so that, with the expander connector connected with the base connector, the pins pass through respective latch plates.

10 Claims, 12 Drawing Sheets

SECTION A-A

DETAIL C
SCALE 5 : 1

DETAIL D
SCALE 5 : 1

G
G
Hole 'Y'
Φ 12.1
11.9
36

2.1
1.9
0.6
0.4
36

20°
15
R 8
15
R 8
Both ends
D
0.2
A
R 20
36

CONNECTOR ASSEMBLY

CROSS-REFERENCE TO RELATED PATENT APPLICATION

The priority application, United Kingdom Application GB 1308252.4, filed May 8, 2013 including the specification, drawings, claims and abstract, is incorporated herein by reference in its entirety.

BACKGROUND OF THE INVENTION

The present invention relates to a connector assembly, in particular for fitment to a vehicle such as a land-based vehicle for traversing rough ground.

Many forms of connector are known for making connection, such as electrical or optical connection, between two components. These connectors may be designed to be attached to and detached from one another in use.

It is an object of the present invention to provide a connector assembly which is more robust than previous arrangements and is better able to withstand ongoing vibrations and occasional large mechanical shocks.

SUMMARY OF THE INVENTION

According to the present invention, there is provided a connector assembly for fitment to a vehicle. The connector assembly preferably includes a base unit for mounting to a vehicle and an expander unit. The expander unit is configured to attach to and detach from the base unit. The base unit preferably includes a base connector face having at least two opposite edges and having therein a base connector. Similarly, the expander unit may include an expander connector face having at least two opposite edges and having therein an expander connector. The expander connector is preferably configured to connect with the base connector for communicating a signal therebetween when the expander unit is attached to the base unit. Two pins may be provided protruding from one of either the base connector face or the expander connector face. The two pins preferably have, at their respective distal ends, respective heads with cross sectional areas of increased magnitude. Two latch plates may be mounted to the other of the connector faces. The two latch plates are preferably rotatably mounted about respective axes which are substantially perpendicular to the connector face. Each of the latch plates preferably has a respective inner surface facing the connector face of its unit and a respective outer surface for facing the connector face of the other unit. Each of the latch plates preferably has an arcuate lock opening with a respective first portion of sufficiently large cross section to allow passage of a head of a respective pin and a respective second portion of cross section to receive the respective pin, but prevent passage of the respective head therethrough. The pins and connector preferably have relative positions matching the relative positions of the latch plates and connector so that, with the expander connector connected with the base connector, the pins pass through respective latch plates. Each latch plate is preferably rotatable about its respective axis between an open position in which it protrudes beyond a respective edge of the connector face and a closed position in which it is flush with the respective edge of the connector face. Preferably, with both latch plates in respective open positions, the connector faces may be moved towards one another such that the pins pass through the respective portions of the lock openings of the latch plates and the expander connector connects with the base connector. With subsequent rotation of both latch plates to their respective closed positions, the pins pass through respective second portions of the latch plates and the respective heads of the pins are held towards the inner surfaces of the latch plates beyond the respective second portions such that the base unit is locked to the expander unit with the expander connector connected with the base connector.

Such a connector assembly, unlike other connectors, can be constructed to ensure a good connection for signals such as electrical or optical signals, whilst also locking the connector together in a manner which is resistant against ongoing vibrations and very large mechanical shocks. The use of the rotatable latch plates allows easy transition between an unlocked state in which the base unit and expander unit may easily be attached and detached and a locked state in which the base unit and expander unit are securely mounted to one another. There is no requirement for particular dexterity of the user to change between the locked and unlocked states. For example, latches may be constructed easily that are operable in arctic conditions with users wearing thick gloves. Nevertheless, the connector assembly allows, in its locked state, a connection which may withstand very large mechanical shocks, for example conforming to the standard specification MIL-S-901.

It will be appreciated that additional pins and respective latch plates may be provided, for instance at other edges of the connector faces. Preferably, so as to provide maximum support for the base connector and expander connector, the pins and respective latches are located diametrically opposed positions relative to the expander connector and base connector.

Preferably, the inner surfaces of the latch plates and the facing connector face include complimentary detent features configured to hold rotationally the latch plates in their respective closed positions.

In this way, a positive and secure mechanism is provided for retaining the latch plates in their closed positions and in which the expander unit is locked to the base unit.

In one embodiment, the detent features include respective indents in the facing connector face and respective detent protrusions on the inner surfaces of each latch plate. With this arrangement, with the latch plates in respective open positions, the detent protrusions may extend beyond the edges of the connector face so as to hold the latch plates in their respective open positions.

This provides a desirable feel to the user and a positive means of securing the latches in their open positions.

Also, it becomes possible to use latch plates both of which are the same shape and size. In particular, a single design of latch plate may be manufactured. Two such latch plates can then be mounted to the connector face with opposite faces connecting the connector face. Preferably, both faces of a single latch plate are formed with a detent protrusion.

Preferably, the connector face receiving the latch plates includes a substantially planar main surface and two recessed surfaces which define respective recesses for receiving the latch plates. The latch plates may be rotatable about their respective axes within the respective recesses.

In this way, the connector face including the planar main surface and recessed latch plates can, overall, have a generally planar surface for facing and/or mating with the opposite connector face.

Each latch plate preferably includes a respective pivot opening at its respective axis about which the latch plate rotates. Also, each latch plate preferably includes a respective arcuate secondary opening radially outward of the respective latch opening. Each latch plate is preferably mounted to the connector face with a respective first member through the pivot opening and a respective second member through the secondary opening. In this way, movement of each latch plate between open and closed positions is limited by relative travel of the respective second member between ends of the respective secondary opening.

For each latch plate, a respective restraining plate may be provided bridging the first and second pins. The restraining plate may thus hold the respective latch plate against the connector face.

It will be appreciated that the expander connector and base connector may be provided to connect one or more of a number of electrical and/or optical signals. These may include electrical power, video signals, internet signals etc. The connector may be a multi-pin connector.

Preferably, the expander connector and the base connector include a presence pin for providing a connection by which a connection between the expander connector and the base connector can be detected.

The present invention also provides a vehicle having a base unit mounted to it. The expander unit may be attached to or formed as part of a device for use with the vehicle, such as a communications unit.

BRIEF DESCRIPTION OF THE DRAWINGS

The invention will be more clearly understood from the following description, given by way of example only, with reference to the accompanying drawings, in which.

DETAILED DESCRIPTION OF THE PREFERRED EMBODIMENTS

An embodiment of a connector assembly according to the present invention will now be described. It will be appreciated that the embodiment is merely a preferred example and variations are possible.

Figure 1:
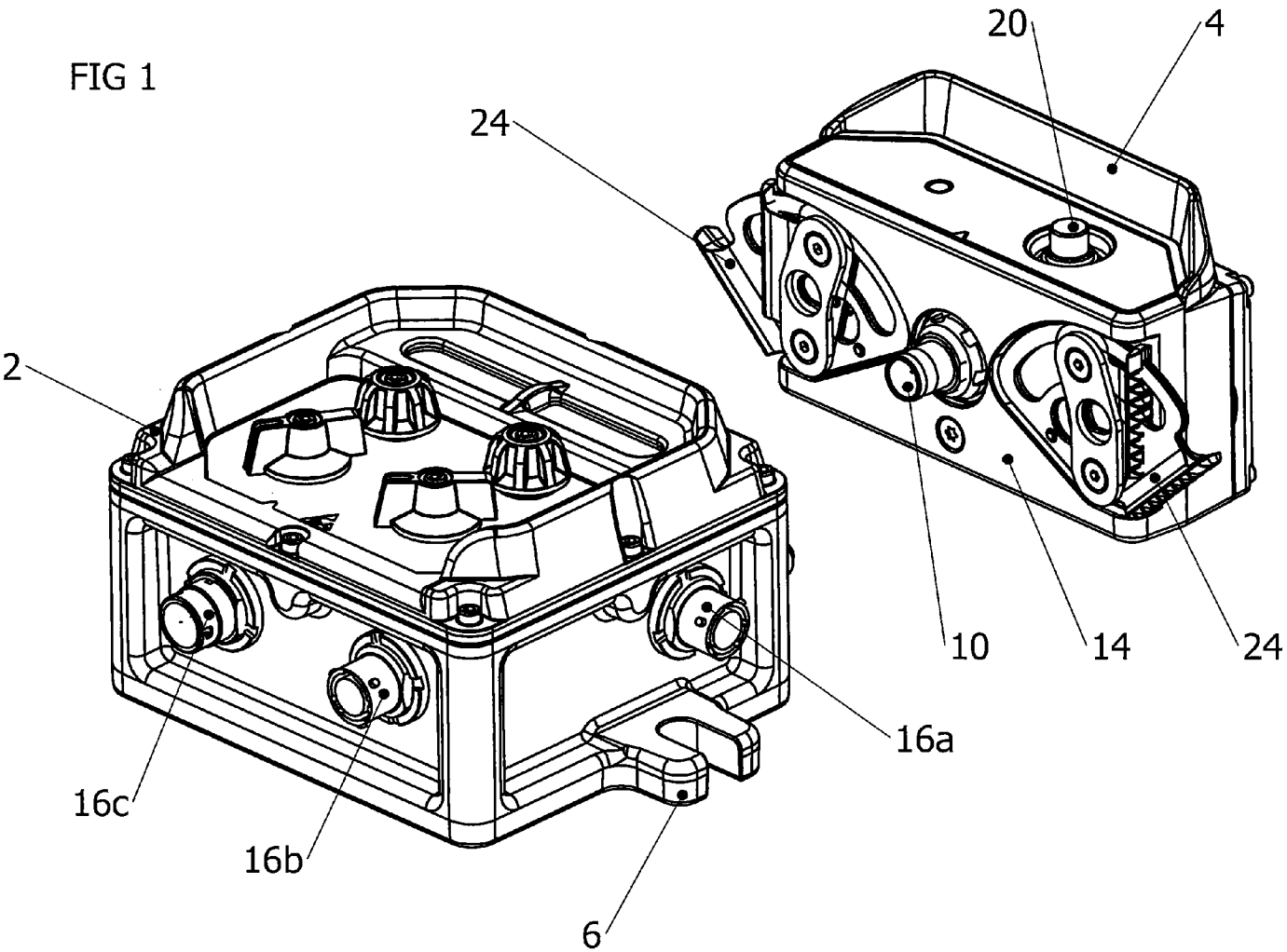
FIG. 1 illustrates a connector assembly embodying the present invention with its base unit and expander unit separated.
Figure 2:
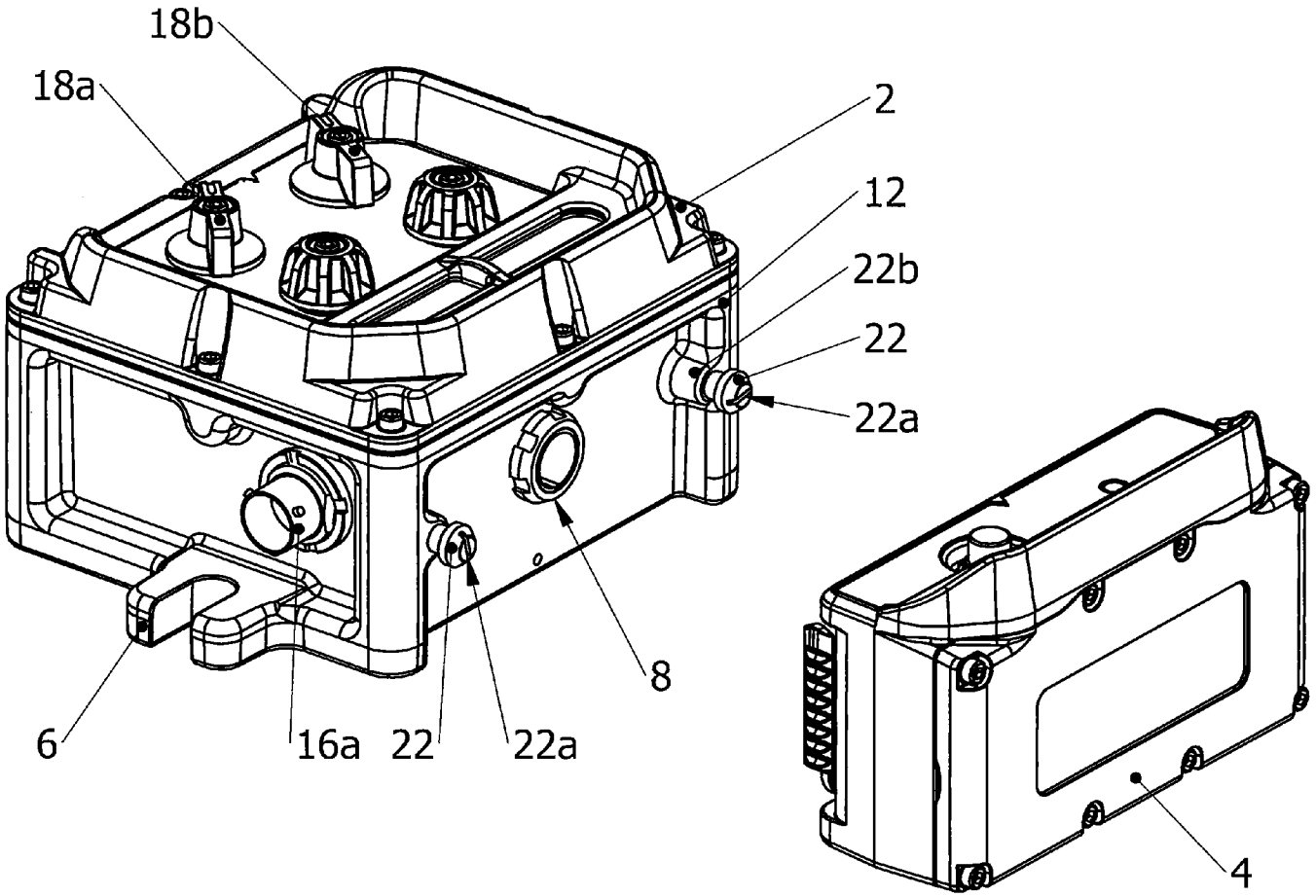
FIG. 2 illustrates an alternative view of the base unit and expander unit of FIG. 1.

FIGS. 1 and 2 illustrate a base unit 2 and an expander unit 4 in an unlocked, detached and separated state.

The base unit 2 is mountable to a main structure, for instance the body or frame of a vehicle, such as a land based vehicle. The illustrated embodiment includes mounting point 6 for securely mounting the base unit 2 to the main structure. Once mounted, it is not intended that the base unit 2 should routinely be removed or detached from the main structure.

The base unit 2 includes a connector 8, described herein as a base connector, for connection with a connector 10 on the expander unit 4, described herein as an expander connector.

In the illustrated embodiment, the base connector 8 and expander connector 10 are multi-pin connectors with the base connector 8 illustrated with insertion holes and forming a female connector. Of course, it will be understood that many alternative types of connector could be used.

Figure 3:
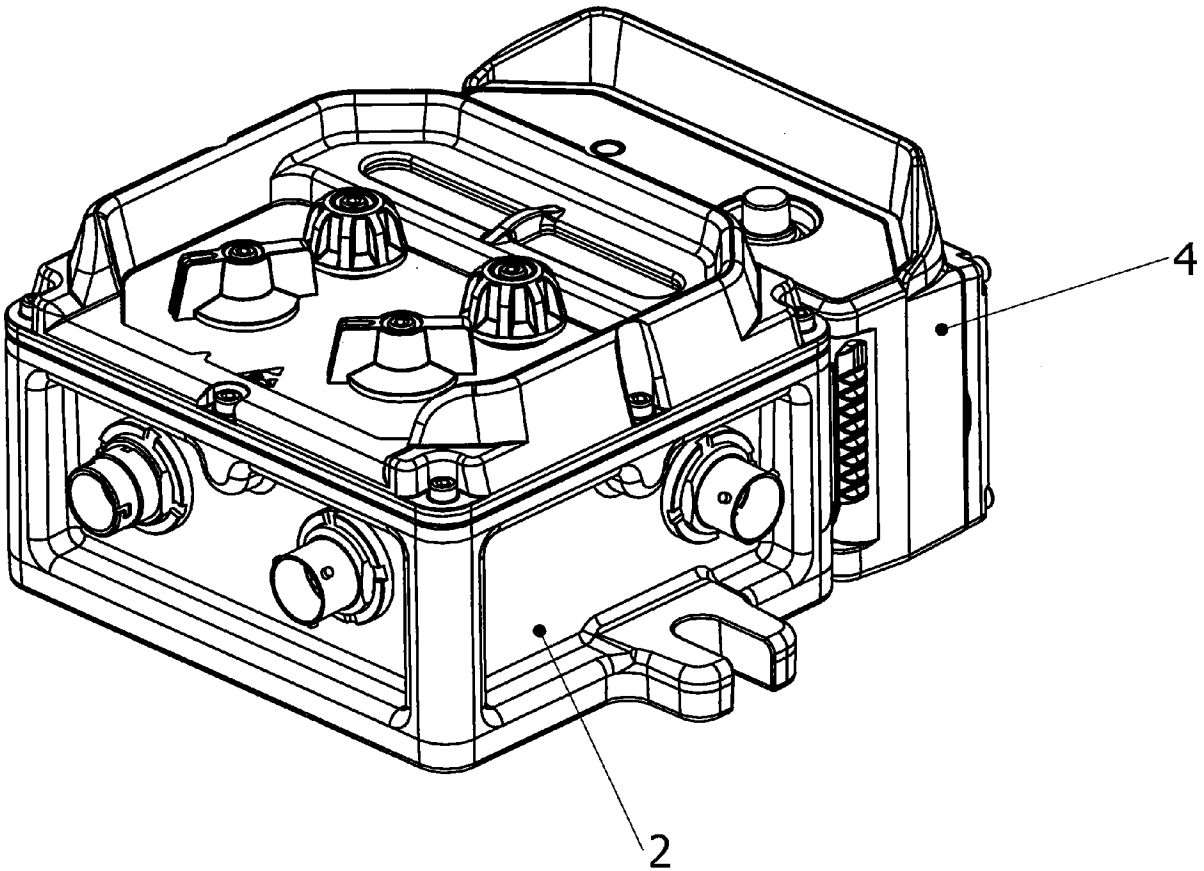
FIG. 3 illustrates the base unit and expander unit of FIG. 1 in an attached state.

The base unit 2 includes a connector face 12 in which the base connector 8 is provided. As illustrated, the connector face 12 is bounded by edges at top and bottom and left and right sides. Similarly, the expander unit 4 has a connector face 14 in which the expander connector 10 is provided. The connector face 14 is also bounded by edges at top and bottom and left and right sides. In use, the connector faces 12 and 14 of the base unit 2 and expander unit 4 are brought together such that the expander connector 10 connects with the base connector 8 and the base unit 2 and expander unit 4 are positioned relative to one another as illustrated in FIG. 3.

The base unit 2 may include one or more of a variety of additional connectors and the illustrated embodiment is shown with three connectors 16*a*, 16*b* and 16*c*. These connectors allow the base unit 2 to be connected with other components in the main structure or vehicle. In some embodiments, such as that illustrated, controls, such as the control knobs 18*a*, 18*b* may also be provided on the base unit 2 for controlling functions or connections within the base unit 2.

The illustrated expander unit 4 is similarly provided with additional switches 20 and connectors (not shown), for example for connecting with an external unit for which the expander unit 4 is mounted. In an alternative embodiment, the expander unit 4 may be formed integrally with an external unit.

As illustrated in FIG. 2, the base unit 2 is provided with a pair of pins 22 which extend outwardly away from the connector face 12. The pins extend in a substantially parallel direction which defines the direction in which the expander unit 4 and base unit 2 may be brought together. Depending on the nature of the connection formed between the base connector 8 and expander connector 10, this direction corresponds with a direction of connection for those connectors 8, 10. Preferably, the direction is substantially orthogonal to the connector face 12.

Mounted towards left and right edges of the connector face 14 of the expander unit 4 are respective latch plates 24 positioned for cooperation with the pins 22 of the base unit 2.

Figure 4:
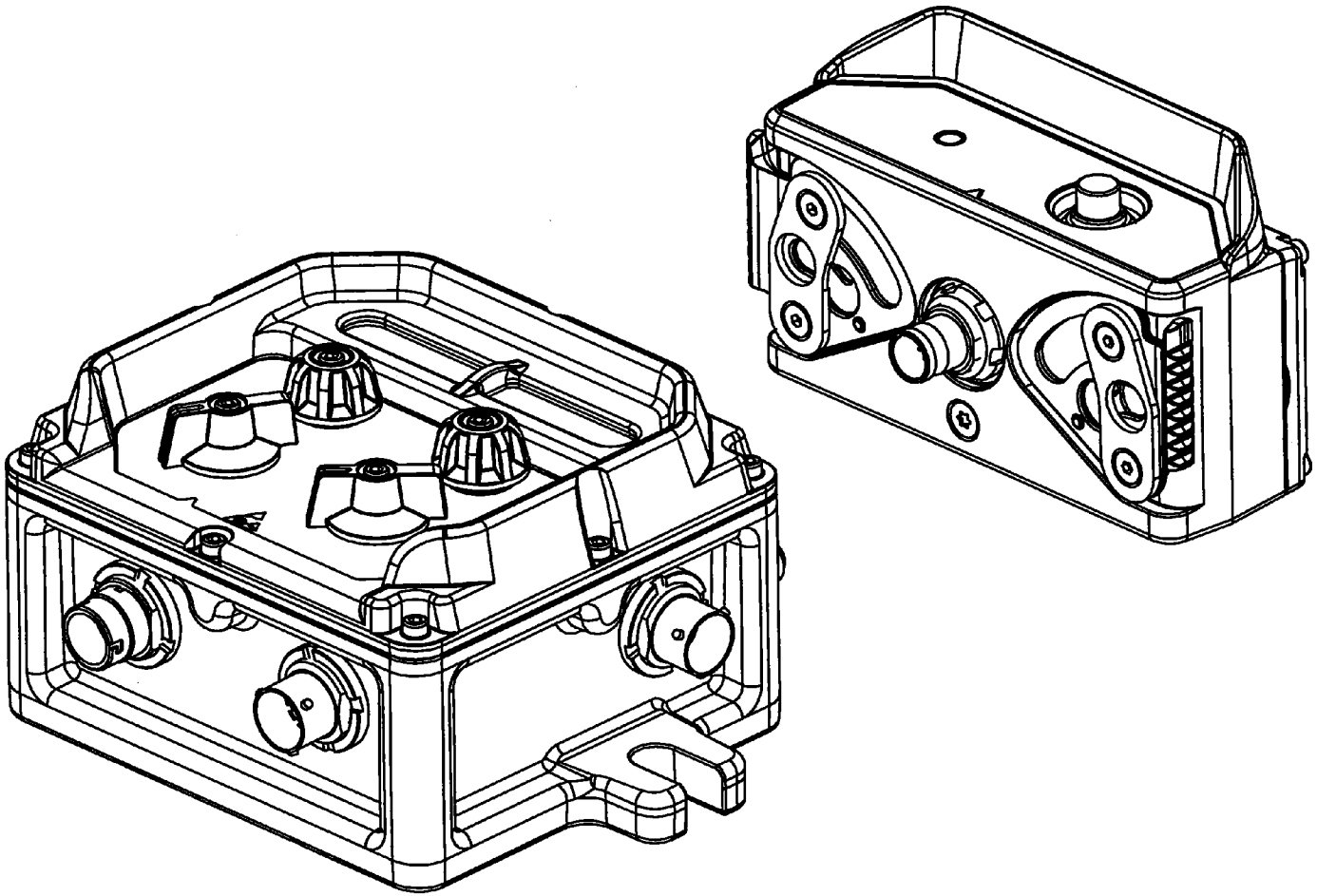
FIG. 4 illustrates the arrangement of FIG. 1 with the latches of the expander unit in closed positions.

Each latch plate 24 is rotatable within a plane substantially parallel with the connector face 14 and about a respective axis substantially orthogonal to that connector face 14. In particular, each latch plate 24 may rotate between an open position as illustrated in FIG. 1 and a closed position as illustrated in FIG. 4.

Figure 5:
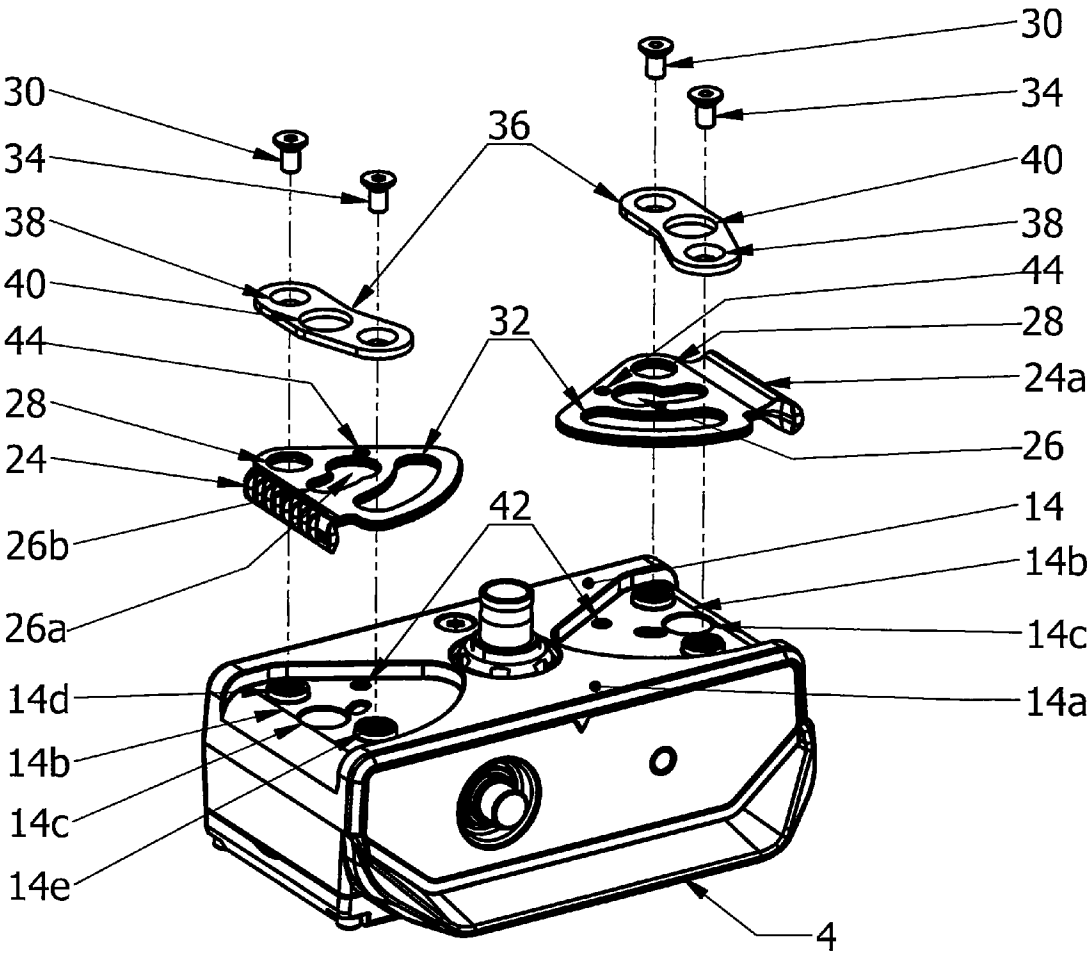
FIG. 5 illustrates an exploded view of component parts of an expander unit.

FIG. 5 shows an exploded view of relevant parts of the expander unit 4.

As illustrated, each latch plate 24 has an inner surface facing the connector face 14 of the expander unit 4 and an outer surface facing away from the expander unit 4. A lock opening 26 is formed through the latch plate 24 between the inner and outer surfaces. The lock opening 26 has an arcuate shape centred upon the axis of rotation of the latch plate 24.

In the illustrated embodiment, each latch plate 24 has a pivot opening 28 for receiving a shaft 14*d* which is part of the expander unit 4 and extends from the connector face 14*b*. The pivot plates 24 thus are pivotable about the respective shafts 14*d* on their respective axes.

As illustrated in FIG. 5, each lock opening 26 includes a first portion 26*a* and a second portion 26*b*. The first portion 26*a* has a larger radial width and cross sectional area than the second portion 26*b*.

Referring now to FIG. 2, it will be seen that the pins 22 have enlarged cross sectional areas at their respective distal ends so as to form heads 22*a*. In other words, inwardly of the heads 22*a* towards the connector face 12, the cross sectional area of the pins is reduced.

The first portion 26*a* and second portion 26*b* of the lock opening 26 are formed with cross sectional areas or radial widths to cooperate with the heads 22*a* and pins 22 respectively. In particular, the first portions 26*a* are sufficiently large so as to allow the heads 22*a* to pass through them. The second portions 26*b* are too small to allow the heads 22*a* to pass through, but are sufficiently large as to allow the smaller cross sectional area of the pins 22 to pass through.

With the latch plates 24 in their open positions as illustrated in FIG. 1, the first portions 26*a* of the lock openings 26 align with the pins 22 such that, when the expander connector face 14 is moved towards the base connector face 12 to connect the expander connector 10 with the base connector 8, the heads 22*a* pass through the respective first portions 26*a*. When the latch plates 24 are then moved to their respective closed positions as illustrated in FIGS. 3 and 4, the latch plates 24 and lock openings 26 move relative to the pins 22 such that the heads 22*a* are positioned between the inner surfaces of the latch plates 24 and the connector face 14 of the expander unit 4. In this state, the expander unit 4 is securely locked to the base unit 2 with the expander connector 10 connected with the base connector 8.

By moving the connector plates 24 back to their open positions as illustrated in FIG. 1, the first portions 26*a* of enlarged cross section again align with the heads 22*a* of the pins 22 and the expander unit 4 may be withdrawn away from the base unit 2.

In the illustrated embodiment, each of the latch plates 24 additionally defines a secondary opening 32 spaced radially outside the lock opening 26 with respect to the axis of rotation. The secondary openings 32 have an arcuate extent with respect to the axis of rotation of the latch plates 24.

As illustrated in FIG. 5, additional shafts 14*e* extending from the connector face 14 pass through the respective secondary openings 32. Preferably, the secondary openings 32 have a radial width corresponding to the diameter of the shafts 14*e* such that the interaction between the secondary openings 32 and the shafts 14*e* help guide accurately the rotational movement of the latch plate 24. Furthermore, the arcuate extent of the secondary openings 32 and, in particular, the two ends of that arcuate extent, define or limit the travel of the latch plates 24 with respect to the shafts 14*e* and define the maximum open and closed positions.

In order to secure the latch plates 24 in position, the illustrated embodiment also includes respective restraining plates 36 extending between the shafts 14*d* and 14*e* for each latch plate 24. Receiving holes 38 are provided for screws 30, 34, such as countersunk screws. The screws 30, 34 thread into respective holes in the shafts 14*d*, 14*e*. Furthermore, a central aperture 40 is provided in each restraining plate 36 positioned so as to align with a respective pin 22 and head 22*a*. The apertures 40 also assist in guiding the heads 22*a* into alignment with the lock opening 26.

It will be appreciated that, because the apertures 40 must have sufficient cross sectional area to allow passage of the heads 22*a*, the cross sectional area of the apertures 40 will be greater than the reduced cross sectional area section of the pins 22. In a preferred embodiment, a base portion 22*b* of each pin 22 proximal the base connector face 12 may have an enlarged cross sectional area matching the cross sectional area, shape and size of the respective aperture 40. In this way, when the expander unit 4 is locked in position with the base unit 2, interaction of the restraining plates 36 with the base portions 22*b* of the pins 22 will help further secure the expander unit 4 to the base unit 2 so as to prevent any relative movement therebetween.

As illustrated in FIG. 5, in the preferred embodiment, the expander connector face 14 preferably includes a substantially planar main surface 14*a* and two respective recessed surfaces 14*b* towards either edge of the expander unit 4. Respective recesses are thus formed in the expander connector face 14 for receiving the respective latch plates 24. The recesses are shaped and sized so as to receive a latch plate 24 in the closed position.

As illustrated, the latch plates 24 include control surfaces 24*a* along each outer peripheral edge of the latch plate 24. The various features of the expander unit 4 are positioned and orientated such that in the closed position as illustrated in FIGS. 3 and 4, the control surfaces 24*a* of the latch plates 24 are substantially flush with the edges of the connector face 14. In this respect, it is possible for the recesses 14*b* to extend partially around the edges or corners of the control face 14 so as to at least partly receive the portion of the latch plate 24 forming the control surface 24*a*.

As illustrated in FIG. 5, the recesses 14*b* may also define additional head recesses 14*c* positioned opposite the apertures 40 of the restraining plate 36 and for receiving the heads 22*a* of the pins 22.

Within the recesses 14*b*, there is also illustrated respective indents 42. On the inner surface of each latch portion 24, there is preferably formed a respective detent protrusion for interacting with an indent 42. Actually, according to the preferred and illustrated embodiment, the two latch plates 24 are manufactured as identical components, but merely mounted to the expander unit 4 with opposite orientations. Hence, the outer surfaces of the latch plates 24 as illustrated also include detent protrusions 44.

In the closed position of the latch plates 24, the detent protrusions 44 of their inner surfaces engage with the indents 42 of the recessed surfaces 14*b* so as to hold the latch plates 24 from relative rotation. Preferably, when the latch plates 24 are in their open positions, the detent protrusions on their inner surfaces are located beyond the edges of the connector face 14 such that they also act so as to hold the latch plates 24 open and restrain them from moving towards their closed positions.

Figure 6:
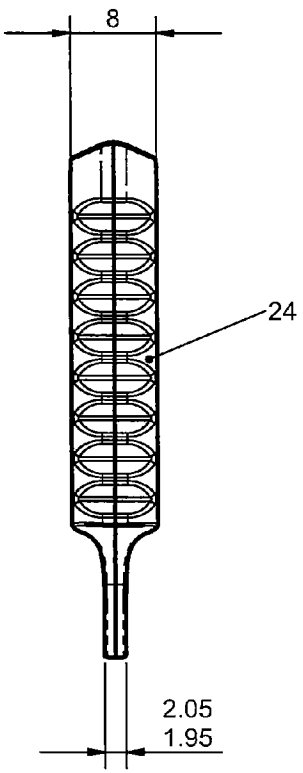
FIGS. 6(*a*) to (*f*) illustrate details of a preferred latch plate.
Figure 6:
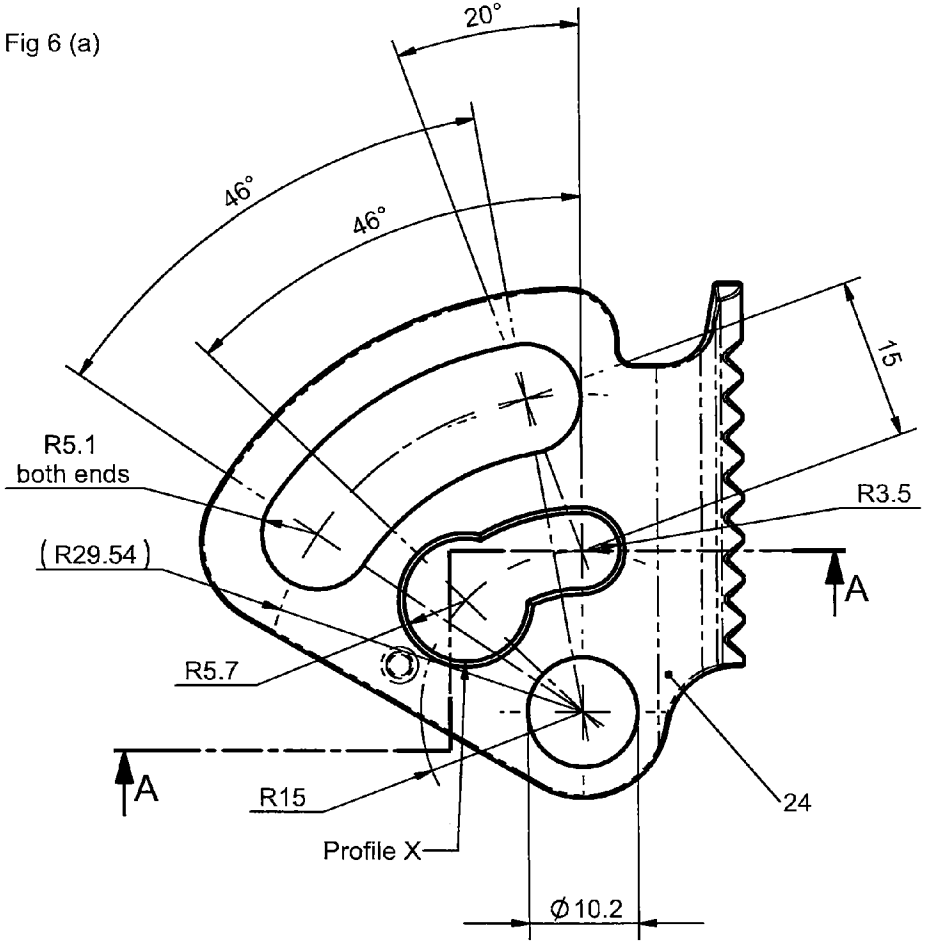
Figure 6:
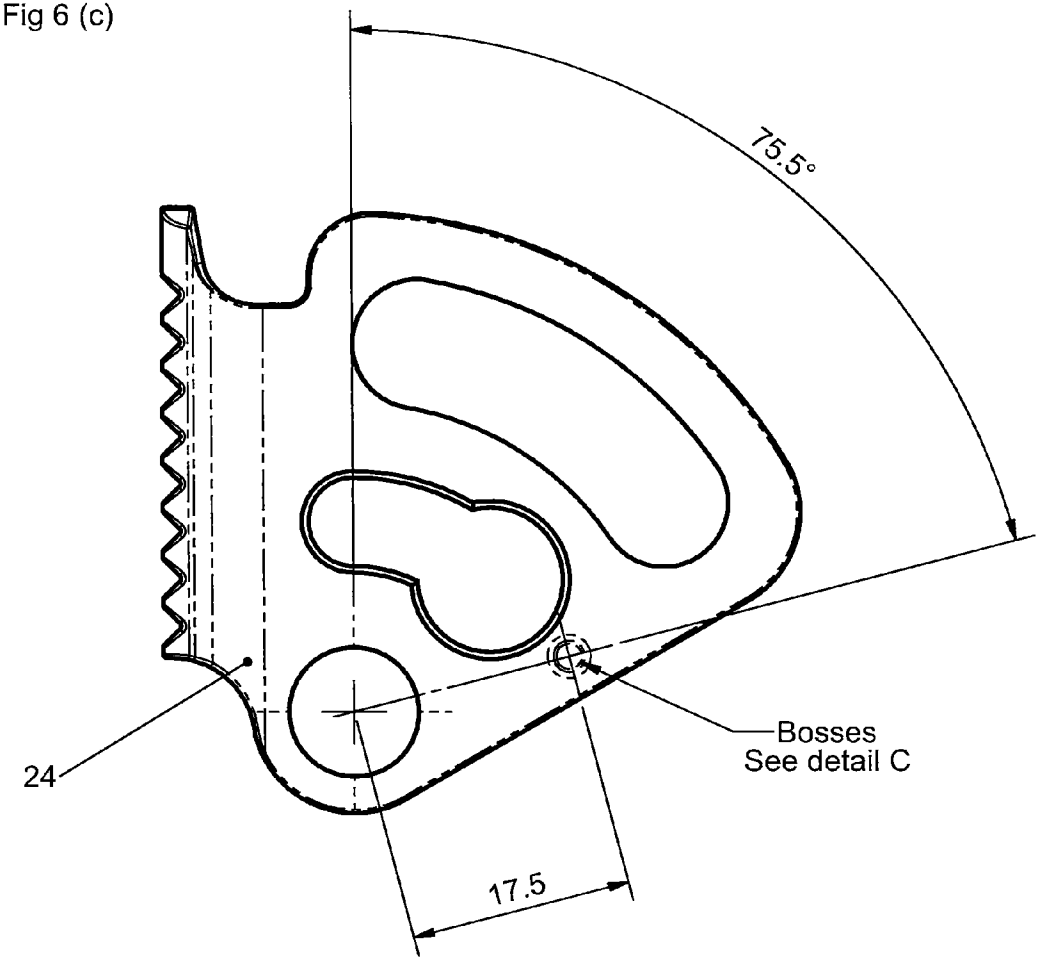
Figure 6:
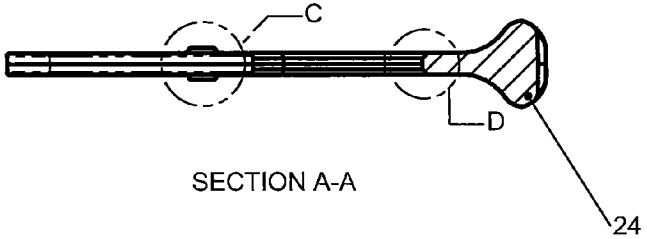
Figure 6:
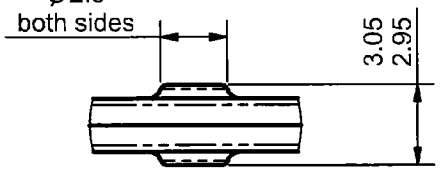
Figure 6:
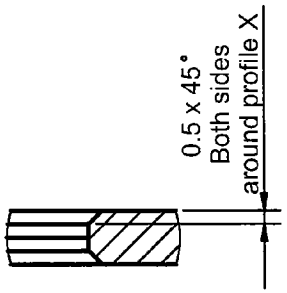

In a preferred construction, the control assembly is constructed so as to meet MIL-S-901 specification. FIGS. 6(*a*) to (*f*), FIGS. 7(*a*) to (*c*) and FIGS. 8(*a*) to (*e*) illustrate respectively appropriate shapes and dimensions for a latch plate, pin and restraining plate. Dimensions are shown in mm and tolerances are preferably +/−0.1 mm and +/−1°. The pin and restraining plate are preferably constructed from austenitic stainless steel (BS 970 Grade 316S11) and the latch plate of polyamide (Grilon BG-25 S or equivalent).

FIG. 6(*d*) shows the cross-section A-A of FIG. 6(*a*) and FIGS. 6(*e*) and (*f*) show details C and D of FIG. 6(*d*).

Figure 7:
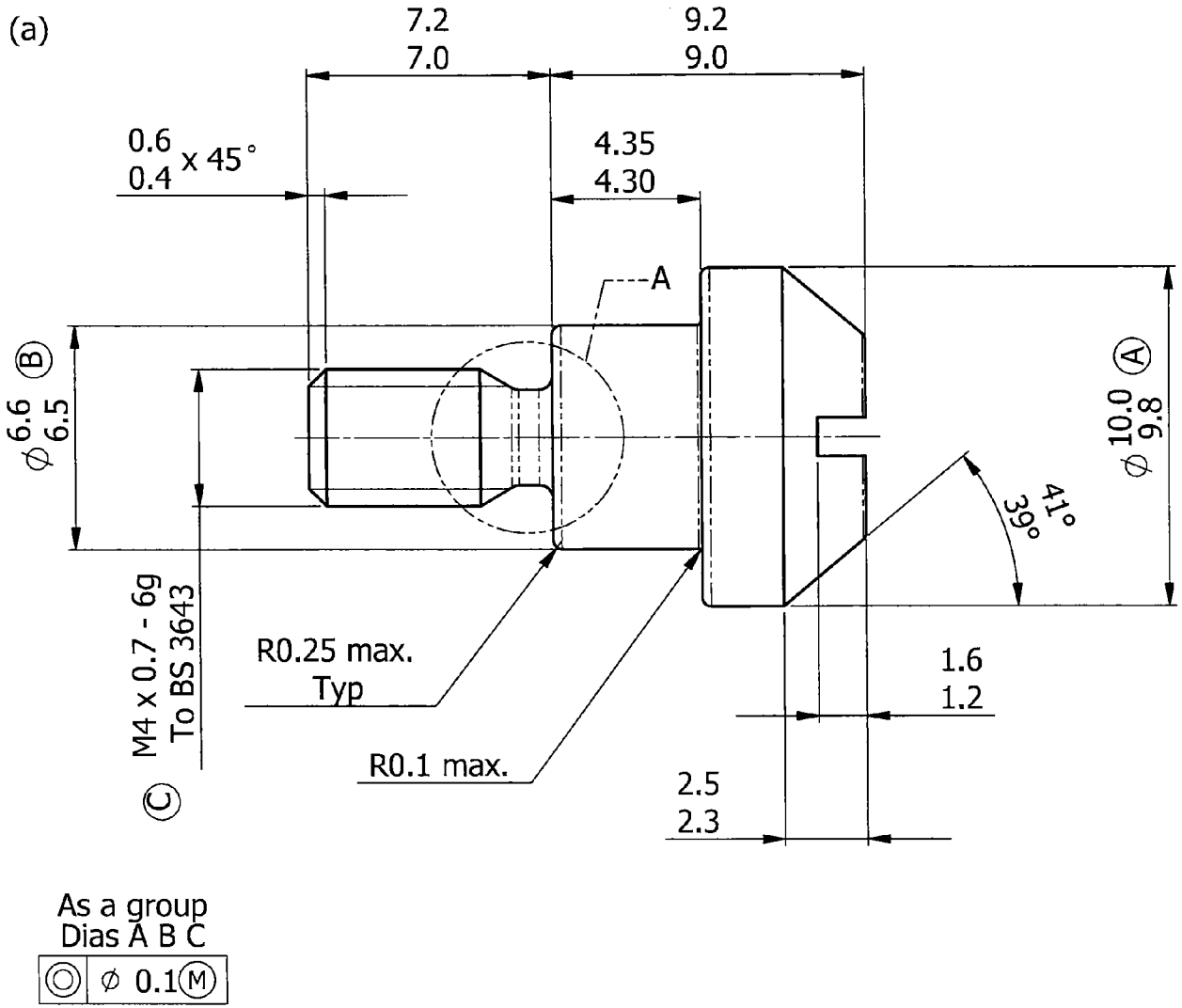
FIGS. 7(*a*) to (*c*) illustrate details of a preferred pin.
Figure 7:
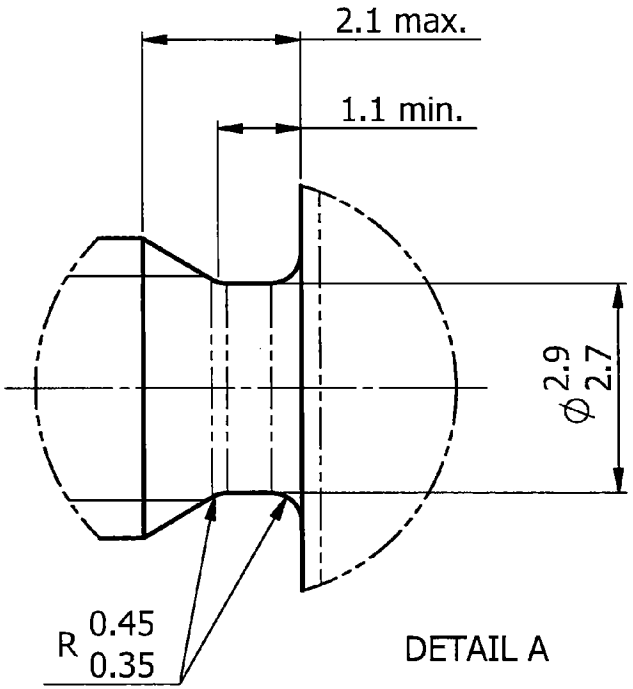
Figure 7:
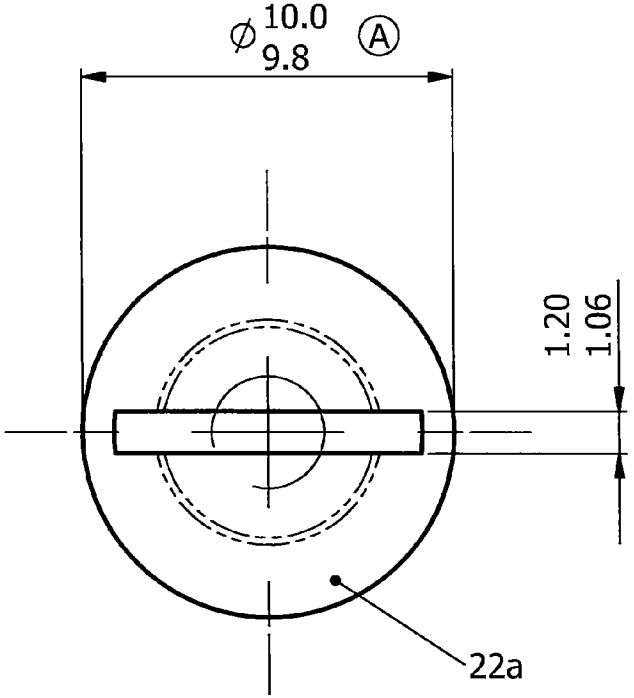

FIG. 7(*c*) shows detail A of FIG. 7(*a*).

Figure 8:
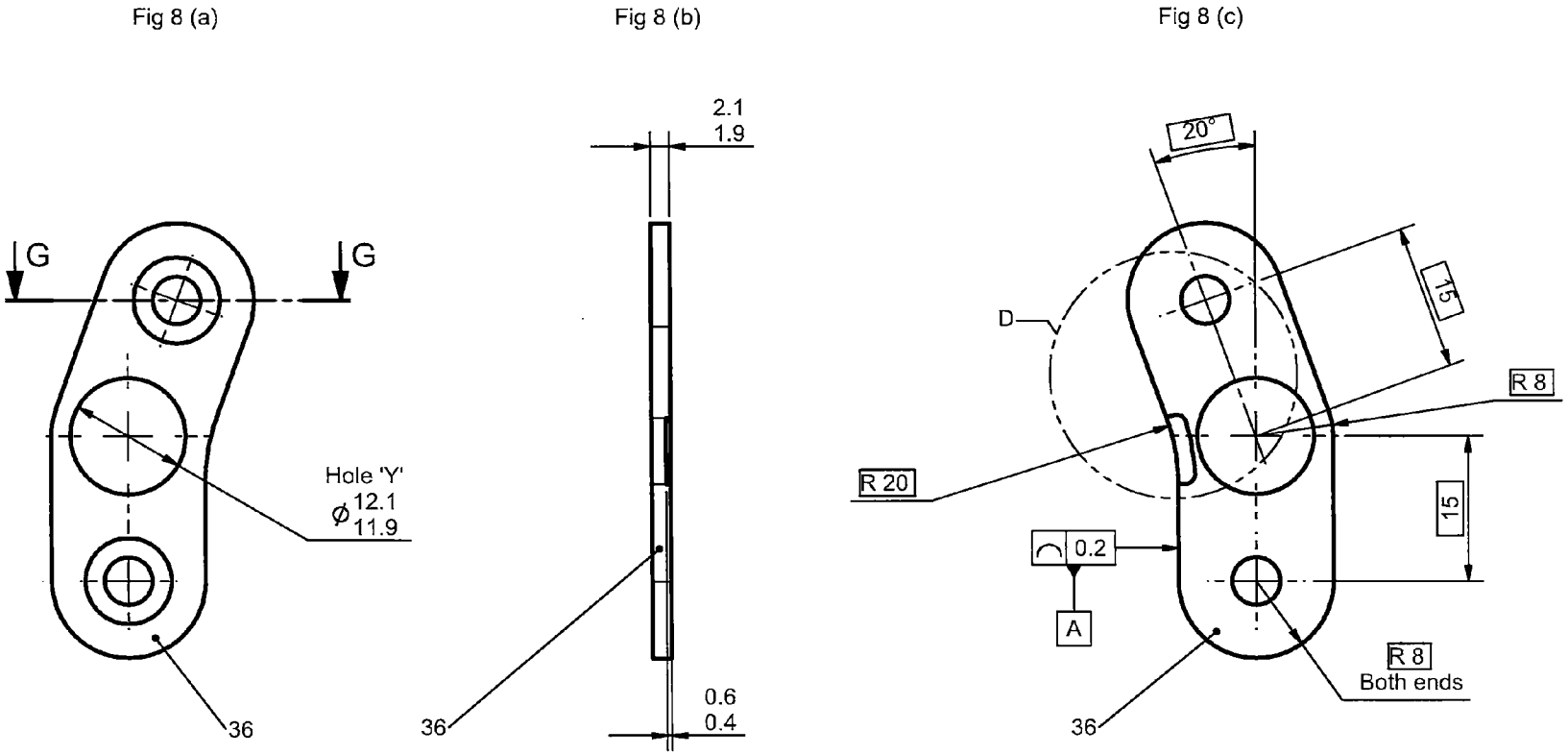
FIGS. 8(*a*) to (*e*) illustrate details of a preferred restraining plate.
Figure 8:
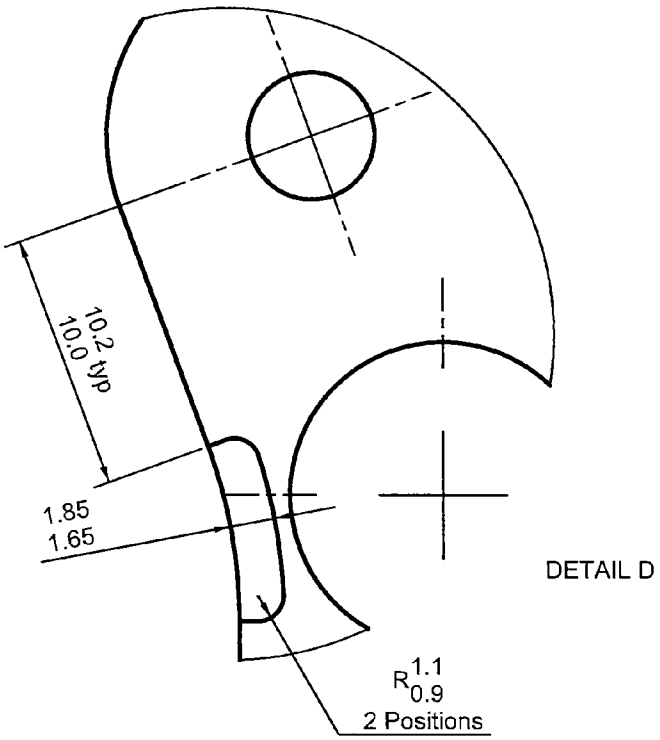
Figure 8:
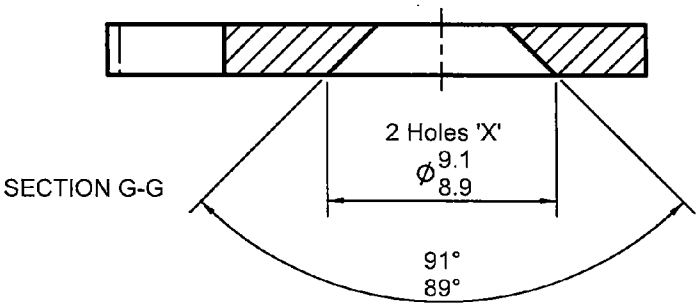

FIG. 8(*d*) shows the cross-section G-G of FIG. 8(*a*) and FIG. 8(*e*) shows detail D of FIG. 8(*c*).

The illustrated embodiment shows pins preferably diametrically opposed either side of the connectors. It will be appreciated that other arrangements are also possible. Furthermore, although only two pins are illustrated in the preferred embodiment, additional pins and corresponding latch arrangements are similarly possible. The preferred embodiment is described for an arrangement providing pins on the base unit. However, a reverse arrangement is possible with pins provided on the expander unit.

Preferably, the base connector 8 and expander connector 10 incorporate means, such as a pin connection allowing the connection between the expander connector and the base connector to be detected.

What is claimed is:

1. A connector assembly for fitment to a vehicle, the connector assembly comprising:

a base unit for mounting to a vehicle and including a base connector face having at least two opposite edges and having therein a base connector;

an expander unit including an expander connector face having at least two opposite edges and having therein an expander connector, the expander unit being configured to attach to and detach from the base unit and the expander connector being configured to connect with the base connector for communicating a signal therebetween when the expander unit is attached to the base unit;

two pins protruding from one connector face of the base connector face and the expander connector face, the two pins having, at their respective distal ends, respective heads with cross sectional areas of increased magnitude;

two latch plates mounted to the other connector face of the base connector face and the expander connector face, the two latch plates being rotatably mounted about respective axes substantially perpendicular to the other connector face, each of the latch plates having a respective inner surface facing the other connector face and a respective outer face for facing the one connector face and each of the latch plates having a arcuate lock opening with a respective first portion of sufficiently large cross section to allow passage of a head of a respective pin and with a respective second portion of cross section to receive the respective pin and prevent passage of the respective head therethrough; wherein:

the pins and connector of the one connector face have relative positions matching the latch plates and connector of the other connector face such that, with the expander connector connected with the base connector, the pins pass through respective latch plates;

each latch plate is rotatable about its respective axis between an open position protruding beyond a respective edge of the other connector face and a closed position flush with the respective edge of the other connector face; and with both latch plates in respective open positions, said one connector face is movable towards the other connector face whereby the pins pass through respective first portions of the lock openings of the latch plates and the expander connector connects with the base connector and, with both latch plates subsequently rotated to respective closed positions, the pins pass through respective second portions of the latch plates and the respective heads of the pins are held towards the inner surfaces of the latch plates beyond the respective second portions such that the expander unit is locked to the base unit with the expander connector connected with the base connector.

2. A connector assembly according to claim 1 wherein the inner surfaces of the latch plates and the other connector face include complimentary detent features configured to hold rotationally the latch plates in the respective closed positions.

3. A connector assembly according to claim 2 wherein the detent features include respective indents in the other connector face and respective detent protrusions on the inner surfaces of each latch plate wherein, with the latch plates in respective open positions, the detent protrusions extend beyond the edges of the other connector face so as to hold the latch plates in the respective open positions.

4. A connector assembly according to claim 1 wherein both latch plates are the same shape and size.

5. A connector assembly according to claim 1 wherein the other connector face has a substantially planar main surface and two recessed surfaces defining respective recesses for receiving the latch plates wherein the latch plates are rotatable about the respective axes within the respective recesses.

6. A connector assembly according to claim 1 wherein each latch plate includes a respective pivot opening at its respective axis and a respective arcuate secondary opening radially outward of the respective lock opening and each latch plate is mounted to the other connector face with a respective first shaft through the pivot opening and a respective second shaft through the secondary opening, movement of each latch plate between open and closed positions being limited by relative travel of the respective second shaft between ends of the respective secondary opening.

7. A connector assembly according to claim 6 further comprising a respective restraining plate bridging the first and second shafts of each respective latch plate for holding the respective latch plate against the other connector face.

8. A connector assembly according to claim 7 wherein the expander connector and the base connector are configured to provide connection of at least one of electrical power, video signals and Ethernet signals.

9. A connector assembly according to claim 1 wherein the expander connector and base connector include a presence pin for providing a connection by which a connection between the expander connector and the base connector can be detected.

10. A vehicle including a connector assembly according to claim 1.

* * * * *